United States Patent [19]

Tsuda et al.

[11] 4,035,140

[45] July 12, 1977

[54] FIXING DEVICE IN AN ELECTROPHOTOGRAPHIC COPYING MACHINE

[75] Inventors: Shinichi Tsuda; Yoshio Nakajo; Kenkichi Tagawa; Hayami Hirai; Shunji Takagi, all of Ebina, Japan

[73] Assignee: Rank Xerox Ltd., London, England

[21] Appl. No.: 729,529

[22] Filed: Oct. 4, 1976

[30] Foreign Application Priority Data

Oct. 28, 1975 Japan ..... 50-146072[U]

[51] Int. Cl.[2] ..... B65H 29/56

[52] U.S. Cl. ..... 432/60; 271/DIG. 2; 271/174

[58] Field of Search ..... 271/DIG. 2, 80, 174; 432/59, 60; 34/120; 118/245; 355/3 R; 100/174

[56] References Cited

U.S. PATENT DOCUMENTS

| | | | |
|---|---|---|---|
| 3,820,776 | 6/1974 | Fujimoto et al. | 271/DIG. 2 X |
| 3,881,859 | 5/1975 | Hamilton | 271/DIG. 2 X |

*Primary Examiner*—Robert W. Saifer

[57] ABSTRACT

A fixing device in an electrophotographic copying machine, wherein stripping members each being in contact with the surface of a heating roll 21, and conveying rolls which serve to convey a support material while the latter being held therebetween, are positioned on feedout sides of the heating roll for thermally fixing a thermoplastic material on the image support material and a pressure roll characterized in that said conveying rolls have their peripheral speeds higher than that of said heating roll.

2 Claims, 3 Drawing Figures

FIXING DEVICE IN AN ELECTROPHOTOGRAPHIC COPYING MACHINE

DETAILED DESCRIPTION OF THE INVENTION

The present invention relates to a fixing device in an electrophotographic copying machine, and more specifically, to a heat roll fixing device of the contact heating type.

Many fixing devices in electrophotographic copying machines heretofore used are of the contact heating type, what is called a heat roll fixing device. This heat roll fixing device has outstanding advantages such that it can be operated with a relatively low electric power and that there is no danger of fire. This heat roll fixing device, however, is suffered from such an inconvenience that an image support material such as paper with a thermoplastic powder comes into direct contact with the surface of a heat roll, as a consequence of which the support material is twisted round the heat roll after fixing.

Figure 3:
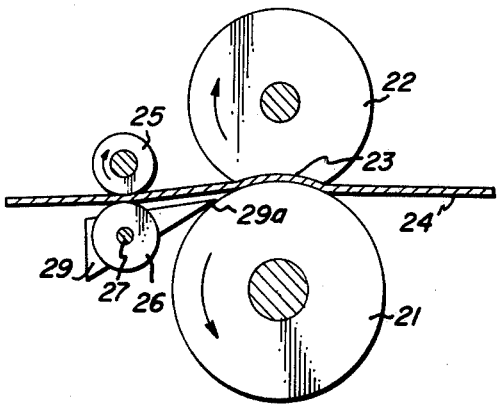
FIG. 3 is a view of assistance in explaining the operation.
Figure 2:
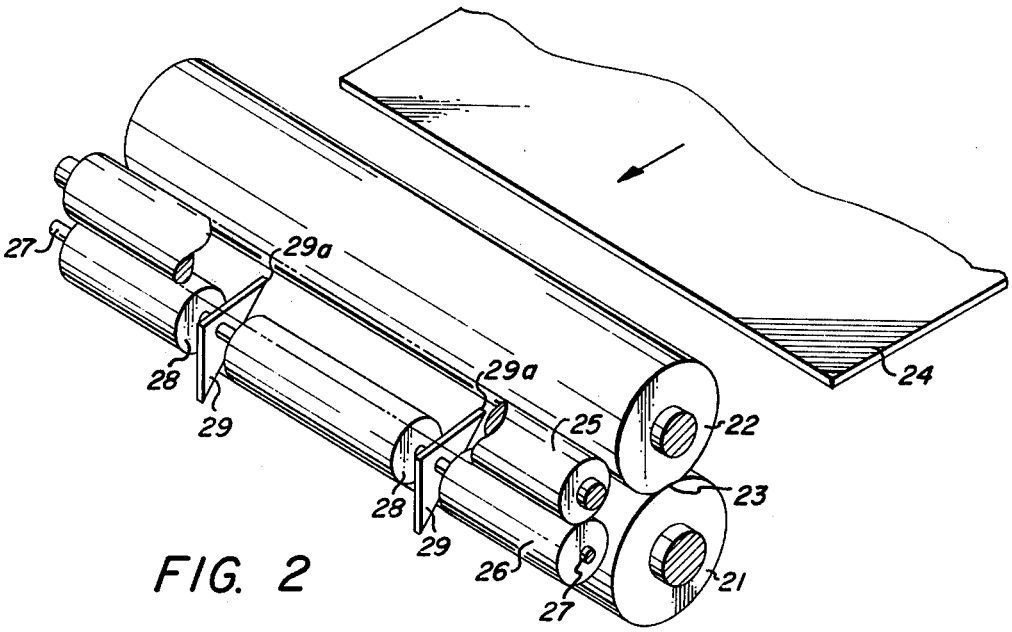
FIG. 2 is a perspective view showing an embodiment according to the present invention.

In FIGS. 2 and 3, 21 denotes a heating roll, 22 a pressure roll, 24 a support material, 25, 26 conveying rolls, and 29 a stripping member.

Figure 1:
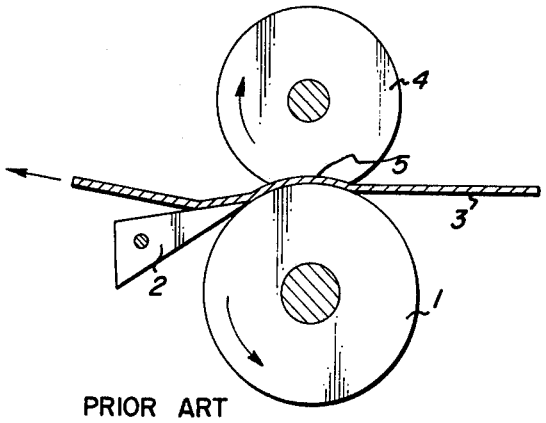
FIG. 1 is an explanatory view of a prior art device.

To overcome such an inconvenience noted above, there has been proposed an arrangement, in which as shown in FIG. 1, a stripping member 2 is brought into contact with the surface of a heating roll 1 to strip a support material 3 adhered to the heating roll 1. A pressure roll 4 is in contact with the heating roll 1.

However, in the fixing device constructed as above, the support material 3, which is fixed and fed from a portion (hereinafter referred to as "nip") 5 between the heating roll 1 and the pressure roll 4, partially comes into contact with the surface of the heating roll 1 while being twisted around the heating roll 1 before the support material is stripped by the stripping member 2, with the result that a drying state of the support material 3 itself is partially varied to occur a waving deformation in the support material 3. Such occurrence of waving deformation in the support material 3 results in disadvantages such as inferior travelling of the support material 3, poor intimate contact with a photosensitive material in a transfer process in the case of employing a both-side copying system, which re-uses the support material leading to a poor transfer, etc.

The present invention has been realized in view of the above, and it is an object of the invention to provide a fixing device in an electrophotographic copying machine, which can avoid occurrence of waving deformation in a support material after completion of fixation.

A preferred embodiment of the present invention will now be described with reference to FIGS. 2 and 3.

FIG. 2 is a perspective view schematically illustrating a fixing device according to the present invention. A heating roll 21 is brought into contact with a pressure roll 22 to form an arc-like nip 23, the heating roll 21 and pressure roll 22 being rotatably driven by means of a drive source not shown.

A pair of conveying rolls 25 and 26 are rotatably mounted adjacent to each other on the side of feeding a support material 24 of the heating roll 21 and the pressure roll 22, and the conveying roll 25 is rotated by means of a drive system not shown at a speed slightly higher than a surface speed of the heating roll 21. The other conveying roll 26 is a follower roll, which is rotatably supported on a shaft 27.

The conveying roll 26 is divided into three sections lengthwise to form clearances 28, 28, between which a stripping member 29 is fitted and supported externally of a shaft 27, and a tip 29*a* of the stripping member 29 is light placed in contact under pressure with the surface of the heating roll 21.

Thus, the support material 24, which has been passed through the nip 23 and applied with a heat fixation, is stripped from the surface of the heating roll 21 by the tip 29*a* of the stripping member 29.

The thus stripped support material 24 is conveyed while being held between the pair of conveying rolls 25 and 26. Since one conveying roll 25 is rotated at a speed slightly higher than the surface speed of the heating roll 21, as previously mentioned, the support material 24 is stretched in a section between the nip 23 and the conveying rolls 25, 26, as shown in FIG. 3, to produce no slackness.

Therefore, the support material 24 will not again contact with the heating roll 21 to thereby prevent an occurrence of waving deformation in the support material.

From the foregoing construction, it will be appreciated in the present invention that the thermally fixed support material 24 will not again contact with the heating roll 21 to prevent an occurrence of waving deformation in the support material 24.

Accordingly, travelling of the support material 24 after fixation may be increased and in addition, even if the support material 24 should be re-used in the case of a both-side copying system, no poor transfer results.

What is claimed is:

1. A fixing device in an electrophotographic copying machine, wherein stripping members (29), each being in contact with the surface of a heating roll (21), and opposing conveying rolls (25 and 26), which serve to convey a support material (24) while the latter is held therebetween, are positioned on a feedout side of the heating roll (21) for thermally fixing a thermoplastic material on said support material (24) and a pressure roll in contact with the heating roll to form a nip therebetween (22), characterized in that said conveying rolls (25 and 26) have their peripheral speeds higher than that of said heating roll (21).

2. A device according to claim 1 including a stripping member pivotally mounted on the same axis as one of said conveying rolls for stripping said support material from said heating roll.

* * * * *